United States Patent [19]

Simons

[11] 4,422,645

[45] * Dec. 27, 1983

[54] GAMEBOARD AND CARRYING CASE

[76] Inventor: Charles R. Simons, 307 Kensington, Ferndale, Mich. 48220

[ * ] Notice: The portion of the term of this patent subsequent to Feb. 24, 1998, has been disclaimed.

[21] Appl. No.: 308,860

[22] Filed: Oct. 5, 1981

Related U.S. Application Data

[63] Continuation of Ser. No. 236,720, Feb. 23, 1981, Pat. No. 4,381,113, which is a continuation of Ser. No. 952,311, Oct. 18, 1978, Pat. No. 4,252,324, which is a continuation-in-part of Ser. No. 748,820, Dec. 9, 1976, abandoned, and Ser. No. 674,986, Apr. 8, 1976, abandoned.

[51] Int. Cl.[3] ..... A63F 3/00

[52] U.S. Cl. ..... 273/286; 206/315.1

[58] Field of Search ..... 273/282, 285, 286, 287; 206/225, 226, 403, 407, 446, 315; 229/93; 150/52 R

[56] References Cited

U.S. PATENT DOCUMENTS

| | | | |
|---|---|---|---|
| 509,316 | 11/1893 | Lapham | 273/286 |
| 4,252,324 | 2/1981 | Simons | 273/286 |

*Primary Examiner*—Richard C. Pinkham
*Assistant Examiner*—Scott L. Brown
*Attorney, Agent, or Firm*—Robert L. Stone

[57] ABSTRACT

A gameboard and carrying case wherein the gameboard is of pliable material, such as leather, so that it is adapted to be rolled into a roll and a carrying case for the gameboard which receives the gameboard when in a rolled condition and in which there are also received within the roll of the gameboard in the bore of that roll, the playing pieces which may be stored in a gamepack for storing play pieces. The game pack may comprise a pair of bags with a maximum opening less than the interior of the rolled gameboard and received within the rolled gameboard.

5 Claims, 8 Drawing Figures

GAMEBOARD AND CARRYING CASE

This is a continuation of application Ser. No. 236,770, filed Feb. 23, 1981, now U.S. Pat. No. 4,381,113, which is a continuation of application Ser. No. 952,311, filed Oct. 18, 1978, now U.S. Pat. No. 4,252,324, issued Feb. 24, 1981 which is a continuation-in-part of application Ser. Nos. 748,820 and 674,986, filed Dec. 9, 1976 and Apr. 8, 1976, respectively, each now abandoned.

FIELD OF THE INVENTION

This invention relates to games and, more particularly, to a combination of a gameboard of pliable material rolled into a roll and stored in a carrying case and a gamepack which holds and stores the play pieces.

BACKGROUND OF THE INVENTION

As is perhaps well known, games such as checkers, chess and backgammon are quite common; however, it is often times inconvenient to carry them. This invention is of a container for receiving, transporting and carrying such a gameboard and the play pieces when not in use.

In the preferred embodiment, the gameboard is of pliable leather or plastic material, as is the container. Indicia on the gameboard surface may be applied by the silk screen method or any other suitable manner of applying indicia on a gameboard. There is thus provided a richly textured soft leather or plastic gameboard and a carrying case to receive it which is of high fashion, is compact for storage, and may be readily transported from one playing location to another; and it is of a long-lasting structure and materials and maintains the play pieces together with the gameboard in a convenient fashion, the play pieces being stored within a gamepack as is described more fully hereinafter.

In accordance with these general objects, the instant invention will now be described with reference to the accompanying drawings in which:

DESCRIPTION OF THE PREFERRED EMBODIMENT

Figures 1, 2, 3, 4, 5, 6, 7, 8:
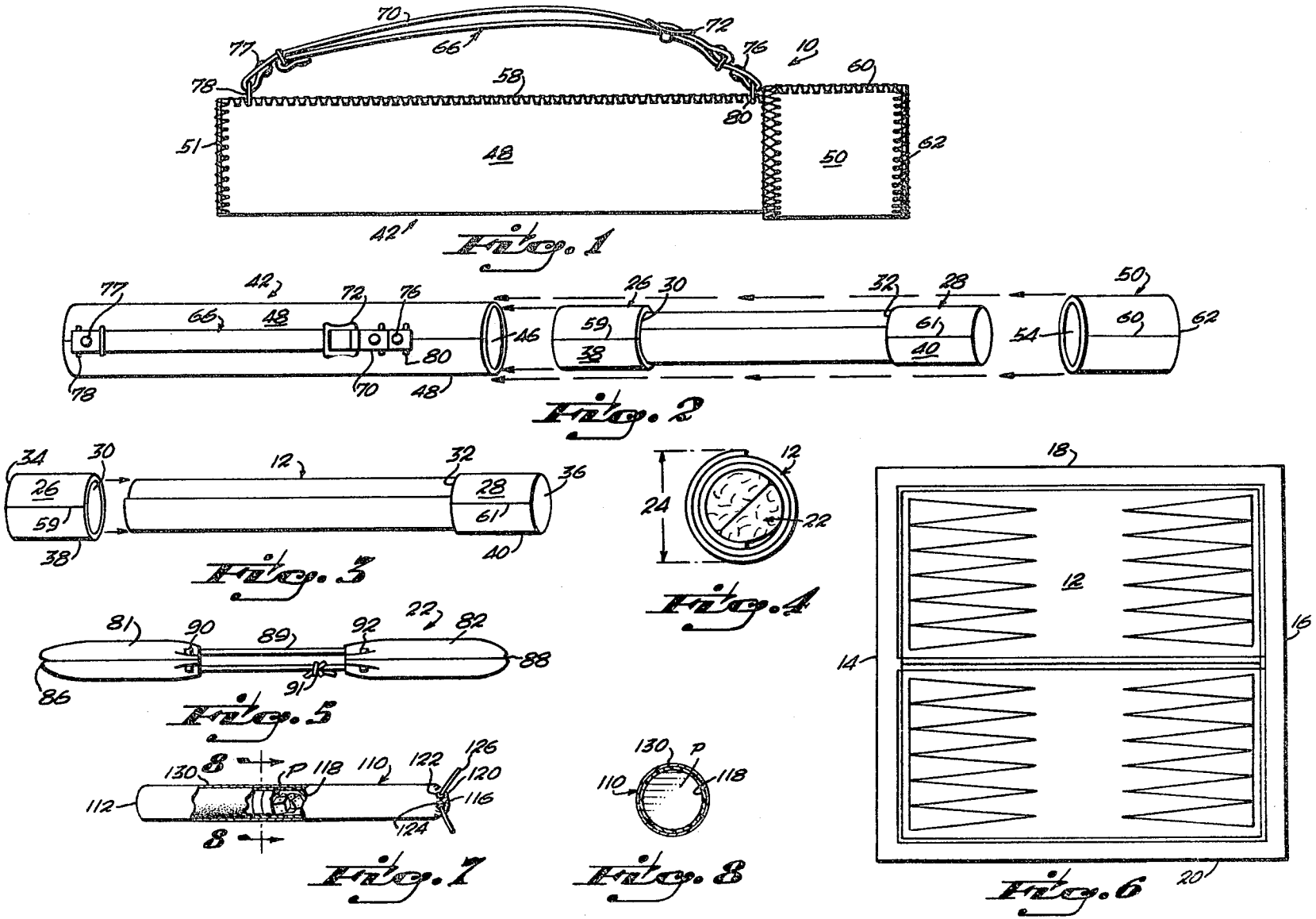
FIG. 1 is a side elevation view of a container for the gameboard according to this invention.
FIG. 2 is an exploded perspective view of the combination shown in FIG. 1.
FIG. 3 is a partially exploded view of the gameboard in a rolled condition with end caps.
FIG. 4 is an end view of the rolled gameboard shown in FIG. 3 with one of its end caps removed.
FIG. 5 is a view of a pair of bags comprising a gamepack to hold playing numbers and which is receivable within the rolled gameboard.
FIG. 6 is a plan view of a pliable gameboard in accordance with this invention.
FIG. 7 is an alternative embodiment wherein the gamepack comprises a tubular member to hold the play pieces.
FIG. 8 is a view in cross section taken on the plane indicated by the line 8—8 of FIG. 7 and looking in the direction of the arrows.

Referring to the drawings wherein like reference characters designate like or corresponding parts throughout the several views, the numeral 10 in FIG. 1 generally designates the container and gameboard. Referring to FIG. 6, the gameboard is shown and there designated by the numeral 12. It is seen that it includes a planar member, which is of pliable material. Thus, it is adapted to be rolled up into a roll with the edges 14 and 16 being parallel to the axis of the roll. The opposing edges of the gameboard are designated 18 and 20, generally rectangular. In the preferred embodiment illustrated, it is a backgammon gameboard, although it might, alternatively comprise a chess board or a checkerboard. Gameboard indicia may be on both sides. As seen in FIG. 2, the gameboard when rolled is capped at the opposite ends by the end caps 26 and 28. The end caps serve as dice cups, for example, when playing backgammon. When the gameboard is rolled there is a bore or long hole through it. The overall outside diameter of the roll, as indicated in FIG. 4, is designated by the numeral 24. The diameter is sized to be received within the recesses 30 and 32 of the end caps 26 and 28 which are composed of end walls 34 and 36 and side walls 38 and 40. The capped gameboard in the rolled condition is adapted to be received within the container 42 defining a receptacle interior designated by the numeral 46 bounded by the side walls 48 and, when inserted therein, the container is capped by an end piece 50 which has an opening 54 sized to receive the end of the container, as shown in FIG. 1. In the embodiment illustrated the end wall 62 is stitched to the side walls as at 62', see FIG. 1, and stitched together as at 60. Additionally, in this embodiment, the container in chief is stitched together and may be formed of leather, the stitching being designated by the numerals 51 and 58. The container may include a carrying strap generally designated by the numeral 66 of elongate length 70 folded back upon itself in a conventional manner and provided with adjustment buckle means 72 and connecting means 76 and 77 to connect to U-shaped brackets 78 and 80 on the exterior of the container. A gamepack is provided to hold the play pieces. With reference to FIG. 5, the gamepack comprises a pair of bags 22 to receive the play pieces, the bags being designated by the numerals 81 and 82. Each of the game bags includes a closed end, such as 86 and 88, and a tie strap which may be of leather to bind them together designated by the numeral 89 which is woven or stitched as at 90 and 92 to the open ends of the bag so as to be able to close them, with the ends tied together as at knot 91.

Alternatively, as seen in FIGS. 7 and 8, the gamepack may comprise a tubular member 110 of a length about the same as but a little less than the distance across the gameboard. In the preferred embodiment it is provided with a closed end 112 and an open end 116. Preferably the tubular member includes a sleeve 118 of rigid material, such as a rigid plastic of predetermined diameter. The diameter is such that (a) when the gameboard is rolled about it, it is sized to receive the dice cup end caps and (b) the column or bore within the sleeve receives the play pieces, as indicated at P in FIG. 7. The exterior of the gamepack may have a leather, cloth or other type pliable material cover 130 which is of a harmonious appearance to that of the entire combination. The margin 120 about the open end may be folded back upon itself to define an annular pocket with a pair of grommet ringed openings 122 and 124 to hold a tie strip 126. Also, instead of the grommet ring openings and the tie string, an elastic ring member may be captivated in the annular pocket to be expanded over the end of the rigid tube, so that the play pieces can be easily removed or inserted while in this condition and, when not in use, the elastic, when positioned axially so as to collapse beyond the end of the sleeve will serve to close the end openings of the gamepack.

It is thus seen that there is provided a compact package of a rolled gameboard capped at the ends which are sized for snug receipt within the bore 46 of the container and capped and in the roll of which the game pieces may be stored and which as a combination may be readily carried by the carrying strap 66; and that the end caps of the gameboard also serve as dice cups.

The longitudinally extending seams 58 of the case 48 and 60 of the end piece 50 and of the end caps 38 and 40, as at 59 and 61, may be somewhat elastic so that the butted end of the pliable material, joined by the respective seams, are somewhat yieldable with respect to one another for minor movement of adjustment when not rolled exactly correctly for ease in packaging of the combination when not in use.

In the preferred embodiment, the game pieces are sized to occupy substantially all of the space within the rigid sleeve, in the embodiment shown in FIGS. 7 and 8. For example, the play pieces are preferably disc-shaped of a diameter of about $1\frac{1}{4}$ inches and the inside diameter of the sleeve is about $1\frac{3}{8}$ inches, which provides a 1/16 clearance about the play pieces when stored within the sleeve of the gamepack.

What is claimed is:

1. In combination, a carrying case, a gameboard, a pair of die tossing cups, play pieces and a game pack for storing the play pieces, said gameboard comprising a sheet of pliable material of uniform thickness having a first and a second pair of opposed right-angularly arranged margin edges spaced from one another a first and a second predetermined distance respectively, and each edge being of said uniform thickness, said gameboard being rolled into a roll and defining a bore of generally circular cross section throughout its length, said length being of a length equal to said first predetermined distance;

said pair of die tossing cups comprising a first and second end cap, said first end cap and said second end cap each having an open end and including a closed circular end wall and a cylindrical axially extending side wall of circular cross section of a predetermined inner diameter substantially equal to the diameter of said gameboard when rolled and each of said end caps including said side walls and end walls being of a common predetermined outer diameter, and each of said end caps being positioned on the ends of said rolled gameboard with the end wall of each cap being in abutting engagement with one of the margins of said gameboard along said second pair of opposed edges and captivated within said end caps and within said axially extending side walls of said end caps, each of said end caps being of an axial length substantially less than one-half the distance between said second pair of opposed edges; and said carrying case comprising a longitudinally-extending tubular container of circular cross-section of an inner diameter substantially equal to but slightly greater than the outer diameter of the cylindrical side walls and end walls of the end caps, said case having a closed end and an open end, and said gameboard and end caps being in said container, said container snugly jacketing said gameboard and end caps, said container being of an axial length substantially equal to but slightly greater than the first predetermined length of said gameboard and the thickness of the end walls of said first and second end caps and said container having an outer uniform diameter;

cap means for said open end of said tubular container, said cap means comprising a cup-shaped member of a diameter substantially equal to said outer diameter of said container and having an axially extending skirt sized to and snugly jacketing said container adjacent said open end and closing said open end of said container; and said game pack comprising a pair of bags, each bag having an open end, a closed bottom and side walls of a maximum opening less than the interior of the rolled gameboard and received in the space within the rolled gameboard.

2. The device as set forth in claim 1 wherein the longitudinally extending tubular container and said first and second end caps are circumferentially yieldable through a minor range of adjustment and include elastic means.

3. The device as set forth in claim 1 wherein a carrying strap is provided comprising a strip having a first end and a second end and means to connect the first end and the second end at spaced points along said container.

4. The device as set forth in claim 1 wherein the carrying strap is of adjustable length.

5. The device as set forth in claim 1 wherein each of said bags includes a tie strap, said tie straps being suitable for binding said pair of bags together and for closing the open ends of each bag.

* * * * *